US008997608B2

(12) United States Patent
Merrick

(10) Patent No.: US 8,997,608 B2
(45) **Date of Patent: *Apr. 7, 2015**

(54) STUD REMOVAL TOOL

(71) Applicant: ToolTech, LLC, Phoenix, AZ (US)

(72) Inventor: Jake Merrick, Hinton, OK (US)

(73) Assignee: ToolTech, LLC, Phoenix, AZ (US)

( * ) Notice: Subject to any disclaimer, the term of this patent is extended or adjusted under 35 U.S.C. 154(b) by 167 days.

This patent is subject to a terminal disclaimer.

(21) Appl. No.: 13/767,704

(22) Filed: Feb. 14, 2013

(65) Prior Publication Data

US 2014/0224076 A1 Aug. 14, 2014

(51) Int. Cl.

| | |
|---|---|
| ***B25B 13/50*** | (2006.01) |
| ***B25B 13/44*** | (2006.01) |
| ***B25B 13/46*** | (2006.01) |

(52) U.S. Cl.

CPC ..... *B25B 13/5016* (2013.01); *B25B 13/44* (2013.01); *B25B 13/462* (2013.01)

(58) Field of Classification Search

CPC ..... B25B 13/28; B25B 13/5075
USPC ..... 81/53.2, 128, 125, 125.1, 52
See application file for complete search history.

(56) References Cited

U.S. PATENT DOCUMENTS

| | | | | | |
|---|---|---|---|---|---|
| 1,294,171 | A | | 2/1919 | Rockwell | |
| 1,740,377 | A | * | 12/1929 | Snyder et al. | 279/71 |
| 2,027,534 | A | * | 1/1936 | Ingersoll | 81/53.2 |
| 2,069,527 | A | * | 2/1937 | Kirkland | 81/53.2 |
| 2,550,929 | A | * | 5/1951 | Keiser | 81/53.2 |
| 4,222,688 | A | | 9/1980 | LeMay | |
| 4,235,134 | A | * | 11/1980 | McLendon | 81/90.2 |
| 4,604,917 | A | | 8/1986 | Polonsky | |
| 4,651,596 | A | | 3/1987 | Rachanski | |
| 4,724,730 | A | * | 2/1988 | Mader et al. | 81/53.2 |
| 4,972,742 | A | | 11/1990 | Brown | |
| 5,251,515 | A | * | 10/1993 | Merrick | 81/53.2 |
| 5,299,473 | A | * | 4/1994 | Weber et al. | 81/53.2 |
| 5,315,902 | A | | 5/1994 | Ragland et al. | |

(Continued)

FOREIGN PATENT DOCUMENTS

| | | | |
|---|---|---|---|
| EP | 0216354 | A2 | 4/1987 |
| JP | 2011104707 | A | 6/2011 |

OTHER PUBLICATIONS

Baconsdozen, "Removing rusted, damaged or worn nuts and bolts." Accessed Oct. 23, 2012. http://www.baconsdozen.co.uk/Rustynuts.htm.

(Continued)

*Primary Examiner* — David B Thomas
(74) *Attorney, Agent, or Firm* — Bracewell & Giuliani LLP

(57) ABSTRACT

An apparatus for removing a stud is described. The apparatus includes a housing, a cage and a canted coil spring. The housing has an interior sidewall with a three-lobed cam and a groove. Each lobe has a counterclockwise cam inner surface and a clockwise cam inner surface on the opposite side of the lobe center line. The cage has a top surface, a tapered terminus and a groove disposed between the top surface and the tapered terminus. The cage includes a plurality of jaws, in which the jaw outer cam surface of each jaw interfaces with the cam inner surface of the interior sidewall. The canted coil spring rotatably couples the cage to the housing. During stud removal, the housing rotates counterclockwise relative to the cage and the cage rotates counterclockwise to engage the stud.

30 Claims, 7 Drawing Sheets

(56) References Cited

U.S. PATENT DOCUMENTS

| | | | | |
|---|---|---|---|---|
| 5,349,887 | A * | 9/1994 | Suwa | 81/128 |
| 5,533,426 | A | 7/1996 | Morales | |
| 5,638,909 | A | 6/1997 | Henderson | |
| 5,690,004 | A | 11/1997 | Weber et al. | |
| 5,799,560 | A | 9/1998 | Meng | |
| 5,904,076 | A | 5/1999 | Siwy | |
| 5,906,146 | A | 5/1999 | Arlen | |
| 6,073,520 | A | 6/2000 | Bueno et al. | |
| 6,099,311 | A | 8/2000 | Wagner et al. | |
| 6,536,309 | B1 | 3/2003 | Pool | |
| 6,807,880 | B1 | 10/2004 | Brian et al. | |
| 6,877,401 | B1 | 4/2005 | Giltner | |
| 6,988,431 | B2 | 1/2006 | DiStasio | |
| 7,140,087 | B1 | 11/2006 | Giltner | |
| 7,437,975 | B1 | 10/2008 | De Anfrasio | |
| 2004/0187646 | A1 | 9/2004 | Whitehead et al. | |
| 2006/0150778 | A1 | 7/2006 | Hennessey et al. | |
| 2008/0016987 | A1 | 1/2008 | Schultz | |

OTHER PUBLICATIONS alltiresupply.com. Grey 1/2" Drive Damaged Nut Remover (#6) (GP-2306NR). Accessed Oct. 23, 2012. http://www.alltiresupply.com/p-GP-2306NR.html.

USABlueBook,com. 10-Pc Damaged Bolt/Nut Remoner Set (Craftsman No. 9-52165). Accessed Oct. 23, 2012. http://www.usabluebook.com/p-289783-10-pc-damaged-boltbut-remover-set-craftsman-no-9-52165.aspx.

MechanicsToolSupply.com, "Damaged Lug Nut Removal Tool AP7401." Accessed Oct. 23, 2012. http://mechanicstoolsupply.com/Damaged-Lug-Nut-Removal-Tool-AP7401_p_24114.html.

NorthernGunParts.com. AR15/M16 Barrel Extension Nut Removal Tool. Accessed Oct. 23, 2012. http://www.northerngunparts.com/ar15m16barrelextensionnutremovaltookaspx.

SearsPartsDirect.com. Bolt-out 5-Piece Damaged Bolt/Nut Remover Set. Accessed Oct. 23, 2012. http://www. searspartsdirect.com/partsdirectipart-number/52061/0009/009&pathTaken=partSearch&blt=14&prst=0&shdPart=52061.

OReillyAutoParts.com. Xtra Seal—Dual Sided Twist Socket Lug Nut Remover. Accessed Oct. 25, 2012. http://www.oreillyauto.com/site/c/detail/XTS0/14840.oap?ck=Search_lug+nut+remover_-1_-1&keyword=lug+nut+remover.

TheToolWarehouse.Net. Damaged Lug Nut Removal Tool. Accessed Oct. 26, 2012. http://www.thetoolwarehouse. net/p-18405-damaged-lug-nut-removal-tool-18mm-and-195mm-flip-socketaspx.

Oswald, Jay Joseph. "Modeling of Canted Coil Springs and Knitted Spring Tubes as High Temperature Seal Preload Devices," Case Western Reserve University, May 2005.

International Search Report with Written Opinion issued in related PCT Application No. PCT/US2014/016459, dated May 20, 2014, 9 pages.

* cited by examiner

STUD REMOVAL TOOL

CROSS-REFERENCE

The present patent application is related to copending application Ser. No. 13/767,727 entitled NUT REMOVAL TOOL filed on Feb. 14, 2013; and copending application FLIP SOCKET NUT REMOVAL TOOL having application Ser. No. 13/767,746 filed on Feb. 14, 2013; and copending application SOCKET FASTENER REMOVAL TOOL having application Ser. No. 13/767,771 filed on Feb. 14, 2013; and copending application DUTCHMAN FASTENER REMOVAL TOOL having application Ser. No. 13/767,758 filed on Feb. 14, 2013.

FIELD

The invention relates to a stud removal tool. More particularly, this invention relates to a tool for the removal of rusted or broken threaded members, such as studs, from a threaded aperture.

BACKGROUND

Studs are a type of fastener with a threaded cylindrical barrel on one end of the fastener that mates with a complementary thread in a fixture. Commonly studs are removed by tightening two nuts together on the accessible threaded side of the stud, and then applying a counterclockwise rotational force to one of the nuts. This technique for stud removal is much more difficult for a stud that has been corroded or has been in the same place for some time. Studs that have been corroded or have been in place for some time are prone to breaking, and so there is a need for a removal tool for broken studs.

A further complication of using manual tools for large stud removal, such as studs used in oil production, is that manual removal of such damaged studs presents danger to the operator. Further, manual removal may be impossible because the degree of torque required is greater than the strength of the operator.

One type of device accomplishes removal by cutting the stud out of the fixture using a blow torch. However, this method of stud removal results in damage to the stud and the fixture. One solution is to use devices that either drill the stud, or cut into the stud, so that torque can be applied to the nut for removal. However, these devices also result in further stripping of the threads of the stud, impeding removal from the fixture.

Another type of device accomplishes fastener removal by inserting an electrode into the broken stud and using a series of intermittent electrical arcs to disintegrate the stud, leaving a stud casing which is then removed manually. Finally the threads of the fixture are cleaned. However, this method of removal results in damage to the stud, is time consuming, involves multiple steps for stud removal, and may result in damage to the fixture.

Other devices using an air impact tool for the removal of large studs exist. Such devices may require a cartridge having many small parts that is used to apply torque to the damaged stud. These multiple small parts of the cartridge, such as multiple helical springs, studs and screws holding gripping jaws together, are prone to breakage when the rotative force of an air impact tool is applied.

Another prior art stud removal tool consists of a housing having a cylindrical bore with finger splits on one end of the housing, and the other end of the housing connecting to an air impact tool. However, the finger splits of the housing cannot fit over multiple stud sizes, so that the tool is limited in usage.

A further complication of the cartridges and associated parts is the use of a retaining ring or clip. The retaining ring or clip is prone to breakage, resulting in a damaged and useless tool.

Another complication of stud removal is side loading, or the mechanical binding of threaded surfaces against each other. When side loading occurs, heat builds up due to friction between the threaded surfaces, creating a gall which is carried through the housing, tearing out the threads and impeding stud removal.

Yet another complication is "chattering," where the tool does not perfectly conform to the size of the fastener. When rotative force is applied using an air impact tool, the removing tool "chatters" over the damaged corners of the fastener, further stripping the fastener or damaging the tool interface with the fastener, and causing 'radii' to form on the end of the tool.

The use of a set of tools having a multiplicity of sizes to conform to different stud sizes exists which proposes to solve the problem of imperfect conformance between removal tool and stud size. However, regardless of the size, the prior art nonetheless results in chattering from an imperfect size conformance; thus, stripping of the thread occurs.

Further, the use of a set of tools having a multiplicity of sizes to conform to stud size presents another complication. If there exists a multiplicity of removal tool sizes in a set, the loss of one of the tools results in a useless tool set.

It would thus be desirable to have a stud removal tool that conforms to the size and shape of a multiplicity of studs, where the jaws of the tool comprise one piece, rather than a multiplicity of smaller pieces which can be easily lost or damaged, and where the jaws are retained within the housing through a shock-absorbing canted coil spring.

SUMMARY

An apparatus for removing a stud is described. The apparatus includes a housing, a cage, and a canted coil spring. The housing has a top end, a bottom end, and a middle section disposed between the top end and the bottom end. The top end includes a top surface and an interior sidewall. The top surface has an orifice that extends through the top end. The interior sidewall extends from the top surface to a lip. The interior sidewall includes a three-lobed cam and a groove. The three-lobed cam is disposed along the interior sidewall of the top end. Each lobe has a lobe center line and a counterclockwise cam inner surface on one side of the lobe center line, and a clockwise cam inner surface on the opposite side of the lobe center line. The groove is disposed between the top surface and the lip.

The cage has a top surface, a bottom portion ending in a tapered terminus and a groove disposed in the bottom portion between the top surface and the tapered terminus. The cage includes a plurality of jaws. Each jaw includes a jaw outer cam surface and an inner frictional surface. The jaw outer cam surface interfaces with the cam inner surface corresponding to the interior sidewall. The inner frictional surface interfaces with the stud. The canted coil spring is received by the groove of the interior sidewall and the groove of the cage. The canted coil spring is rotatably coupled the cage to the housing. During stud removal, the housing rotates counterclockwise relative to the cage. The cage rotates counterclockwise to engage the stud, and the cage interfaces with the interior sidewall.

The canted coil spring operates within a constant deflection range, when an axial load is applied by the housing and the cage.

In one embodiment, the canted coil spring has the coils canted in a clockwise direction. In another embodiment, the canted coil spring has the coils canted in a counterclockwise direction.

In the illustrative embodiment, the lobe center line for each lobe is 120° apart, each lobe occupies a 120° arc, the counterclockwise cam interface has a 60° arc, and the clockwise cam interface has a 60° arc. In the illustrative embodiment, each lobe is substantially semi-circular. In a further illustrative embodiment, each jaw outer cam surface occupies a 60° arc.

In the illustrative embodiment, the jaw outer cam surface is configured to engage with the counterclockwise cam interface when a counterclockwise force is applied to the housing. In a further embodiment, the jaw outer cam surface is configured to engage with the clockwise cam interface when a clockwise force is applied to the housing.

In another illustrative embodiment, an elastomeric component is configured to join the plurality of jaws.

In the illustrative embodiment, the bottom end interfaces with an impact rotary tool that can oscillate between applying a counterclockwise force and a clockwise force. Additionally, the bottom end further comprises a slot that receives a pin that is inserted within the slot when the housing interfaces with the impact rotary tool.

DRAWINGS

DESCRIPTION

Figure 1A:
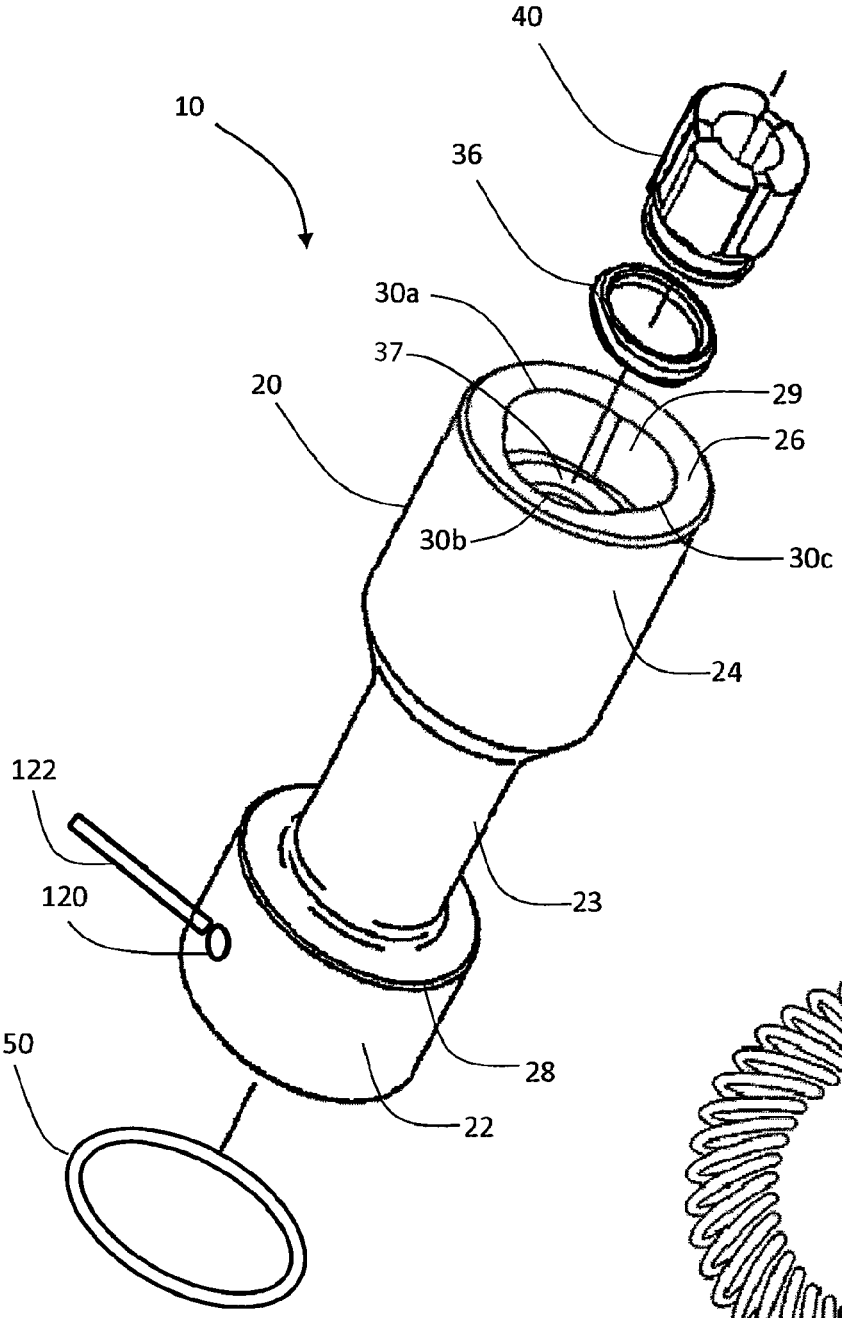
FIG. 1A shows an isometric view of an illustrative stud removal tool.

Persons of ordinary skill in the art will realize that the following description is illustrative and not in any way limiting. Other embodiments of the claimed subject matter will readily suggest themselves to such skilled persons having the benefit of this disclosure. It shall be appreciated by those of ordinary skill in the art that the apparatus and systems described herein may vary as to configuration and as to details. Additionally, the methods may vary as to details, order of the actions, or other variations without departing from the illustrative method disclosed herein.

The stud removal tool described herein is used for the removal of rusted or broken threaded members, such as studs, from a threaded aperture in a fixture. Generally, the removal of the stud employs an impact wrench tool. Alternatively, other tools that provide needed torque may also be used. By way of example and not of limitation, the stud removal tool described herein may be used to remove studs that are deployed in oil production or power generation.

For purposes of this patent, the terms "cage" and "cartridge" will be used interchangeably. By way of example and not of limitation, the cage "floats" or rests on an illustrative canted coiled spring which is used to engage the cage with a housing that receives a counterclockwise force.

For purposes of this patent, the terms "fastener" and "stud" will be used interchangeably. Fasteners are generally cylindrical and have a threaded end which mates with complementary threads within a fixture. Studs and threaded rods do not have heads; studs may have a threaded top portion and a threaded bottom portion with a middle section that does not have threads.

The canted coil spring is presented in the illustrative spring technology that allows the cage to rotate freely, while ensuring that the cage does not slide out of the housing. Alternatively, a knitted spring tube may also be used instead of the canted coil spring. The canted coil spring and the knitted spring tube may also be referred to as a seal preload device. Other spring technologies may also be used that allow the cage (which grips the stud) and the housing (which interfaces with the cage) to rotate freely in either a counterclockwise or counterclockwise direction, while at the same time ensuring that the cage does not slide out of the housing.

Additionally, the illustrative embodiment presented herein includes a three-lobed cam along the interior sidewall of the housing as described in further detail below. The three-lobed cam is configured to interface with the cage, which interfaces with a stud. Each lobe of the illustrative three-lobed cam occupies a 120° arc and has a lobe centerline, a counterclockwise cam inner surface on one side of the lobe centerline, and a clockwise cam inner surface on the opposite side of the lobe centerline.

Generally, a counterclockwise force (to loosen stud) is applied to the housing for stud removal, this counterclockwise force is transferred to the cage, when the cage interfaces with the counterclockwise cam inner surface. There may be instances when additional torque is applied during stud removal and this may require the application of a clockwise force (tightening the stud), and then reverting back to the counterclockwise force.

The three-lobed cam described below is provided for illustrative purposes only. Alternatively, other lobed cam assemblies may also be used such as a two-lobed cam, a four-lobed cam, five-lobed cam, etc. The number of lobes and configuration of each lobe will depend on the particular application.

Referring to FIG. 1A, there is shown an illustrative stud removal tool 10. The stud removal tool includes a housing 20. The housing may be composed of a material having the appropriate tool steel grade or stainless steel grade. The housing may be manufactured by machining, utilizing a mold, or other such manufacturing techniques that are specific to tool manufacturing. The housing includes a bottom end 22 with a bottom surface (not shown), a middle section 23, and a top end 24 having a top surface 26. The bottom end 22 of the housing may interface with a rotary tool such as an impact wrench (not shown). The bottom end also includes an exterior cylindrical shaft 28 with a thickness greater than shaft thickness of the middle section 23.

The top end 24 also has a shaft thickness greater than middle section 23 shaft thickness. The top end 24 includes a top surface having an orifice defined by internal sidewall 29 that extends throughout the top end 24 portion. The interior sidewall 29 extends from the top surface 26 to a lip (not shown). The interior sidewall 29 includes a plurality of cam inner surfaces 30*a*, 30*b* and 30*c* along the interior sidewall 29 of the top end 24.

By way of example and not of limitation, the housing 20 is constructed of heat treated S7 steel that measures 52-54 on the Rockwell C scale, as measured with a Hardness Tester, such as that described in U.S. Pat. No. 1,294,171, "HARDNESS TESTER," Hugh M. Rockwell and Stanley P. Rockwell, issued Feb. 11, 1919. S7 steel is a shock-resistant, air-hardening steel used for tools, and which is designed for high impact resistance at relatively high hardness in order to withstand chipping and breaking. Other alloys may also be used. Steels used are not plated or coated, other than surface treatment to produce a black oxide finish for corrosion resistance.

Figure 1B:
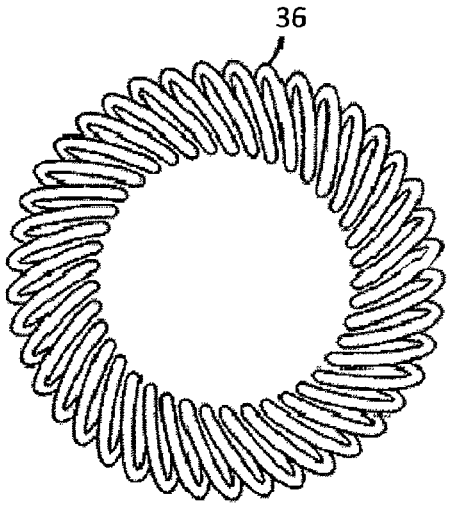
FIG. 1B shows an exploded view of a canted coil spring.

A canted coil spring 36 rests within a groove in the top end 24 section. FIG. 1B presents an exploded view of the canted coil spring 36. More generally, the canted coil spring may be referred to as a seal preload device. For example, another illustrative seal preload device is a knitted spring tube, as shown in FIG. 2D. The canted coil spring 36 engages the cage 40 to the housing 20, while enabling the cage to "float" on the housing.

Figure 3A:
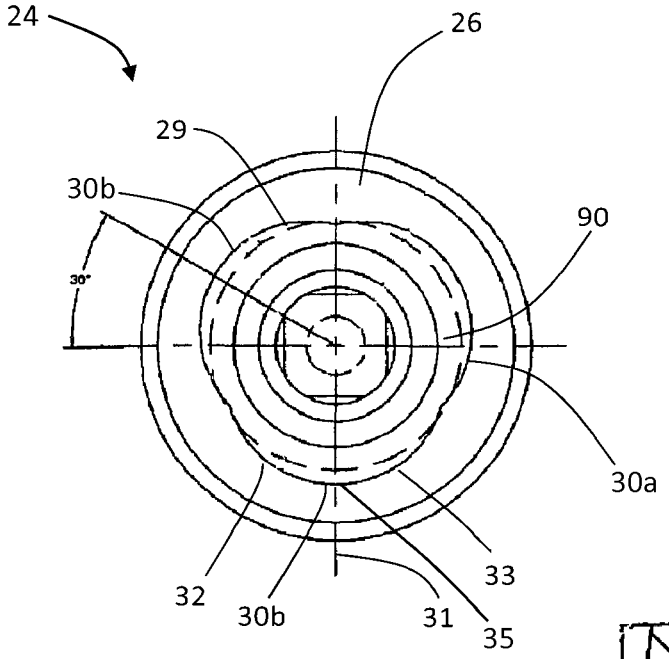
FIG. 3A shows a top view of the illustrative stud removal tool.

As shown in FIG. 1A, the canted coil spring 36 and the top end 24 are configured to receive the cage 40. The top end 24 is shown in further detail in FIGS. 3A, 4 and 7 presented hereinafter. The cage 40 is described in further detail at FIGS. 5-6. The illustrative bottom end 22 of the housing 20 receives an illustrative O-ring 50, which is configured to interface with an illustrative impact wrench (not shown). Alternatively, the O-ring 50 can be replaced with a second canted coil spring. Further detail regarding the bottom end 22 of the housing 20 is presented in FIG. 3B, which shows a bottom view of the bottom end 22.

In the illustrative embodiment, the bottom end is configured to receive an impact rotary tool. The bottom end may further include a slot 120 configured to receive a pin 122 that is inserted within the slot 120 when the housing 20 is configured to interface with a rotary tool. The pin 122 holds the rotary tool in place.

More generally, the stud removal tool 10 includes a fastening component with a biasing element that is configured to allow the cage 40 and the housing 20 to rotate freely in a counterclockwise or clockwise direction, and also enables the cage 40 to stay within the housing 20 during stud removal operations. The illustrative fastening component with the biasing element presented herein includes a seal preload device such as a canted coil spring. An alternative biasing element may include a clip.

Figure 2A:
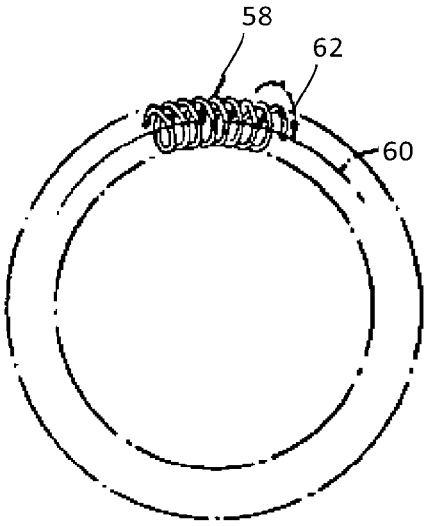
FIG. 2A shows a canted coil spring wound in a clockwise direction about the coil centerline.
Figure 2B:
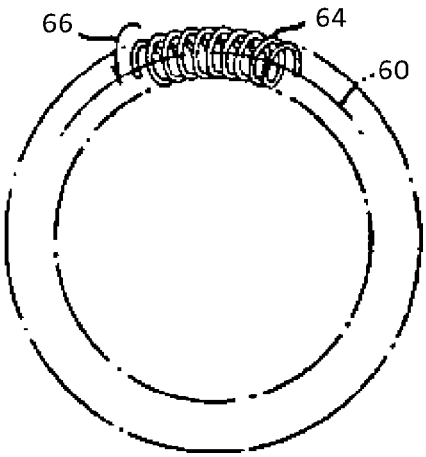
FIG. 2B shows a canted coil spring wound in a counterclockwise direction about the coil centerline.

The illustrative embodiment may include one of two types of canted coil springs, as shown in FIGS. 2A and 2B. The first type of canted coil spring 58 presented in FIG. 2A has the coils wound in a clockwise direction about the coil centerline 60 as indicated by arrow 62. The second type of canted coil spring 64 is shown in FIG. 2B and has the coils wound in a counterclockwise direction about the coil centerline 60 as indicated by arrow 66.

Figure 2C:
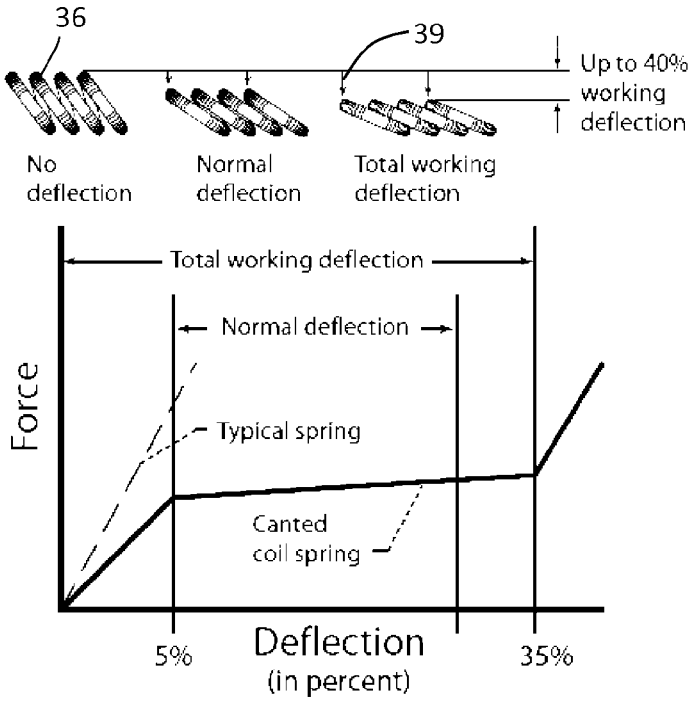
FIG. 2C shows a canted coil spring with deflection and a graph of force and deflection.
Figure 2D:
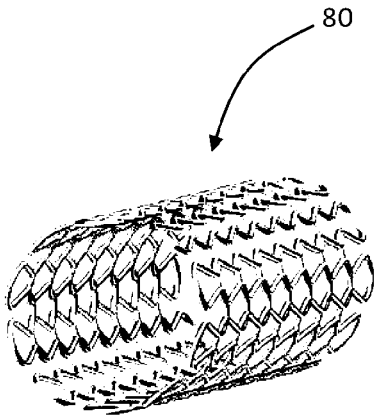
FIG. 2D shows an illustrative knitted spring tube.

Referring now to FIG. 2C there is shown side view of a canted coil spring 36 subject to deflection from an axial load. An axial canted coil spring has its compression force 39 parallel or axial to the centerline of the arc or ring. The graph of force vs. deflection shows the canted coil spring 36 being subjected to a range of compressive (axial) forces. As more force 39 is applied to the canted coil spring 36, the angle between the coils and the vertical axis increases. In the "normal deflection" range shown in FIG. 2C, the normal deflection indicates that the force produced by a canted coil spring 36 is nearly constant over a long range of deflection, especially when compared to a typical spring. This enables the cage 40 to "float" on the canted coil spring 36.

As described in further detail below, the canted coil spring 36 is installed within grooves in both the housing 20 and the cage 40. The canted coil spring design may be designed according to the following illustrative parameters, namely, the wire material, the wire diameter, the cant amplitude, the coils per inch, the size controlled by spring width, and eccentricity. The cant amplitude is the axial distance the top coil is shifted compared to a helical spring. The eccentricity is a parameter that indicates a circular cross section; as the eccentricity increases the spring becomes more elliptical. Some manufacturers use other parameters to design a canted coil spring such as the front angle and the back angle instead of coils per inch and cant amplitude.

When a canted coil spring is deformed, the top of the coils slide against the contact surface and the bottom coils rotate about their axis. For example, the bottom of the spring is constrained axially so the coefficient of friction is greater at the contact between the spring and the bottom surface than the spring and the top surface. This process enables the cage to "float" on the canted coil spring.

Another illustrative seal preload device is a knitted spring tube shown in FIG. 2D. The knitted spring tube 80 includes a series of needles interwoven about a base helix. The needle pattern is defined by the combination of a circular section and a linear section, in which both sections are piecewise continuous and smooth at their intersection.

Other parameters to consider for designing canted coil springs and knitted spring tubes are provided in the thesis entitled MODELING OF CANTED COIL SPRINGS AND KNITTED SPRING TUBES AS HIGH TEMPERATURE SEAL PRELOAD DEVICES by Jay J. Oswald submitted in May 2005.

Referring now to FIG. 3A, there is shown an illustrative a top view of the top end 24 having a three-lobed cam. The housing includes a top surface 26, a lip 90 and a groove (not shown) that the canted coil spring 36 interfaces with. The interior sidewall 29 extends from the top surface 26 to the lip 90. The interior sidewall includes the three-lobed cam inner surfaces 30*a*, 30*b* and 30*c* along the interior sidewall 29.

By way of example and not of limitation, the cam inner surfaces 30*a*, 30*b* and 30*c* are equidistant from each other so the arcs occupied by the cams are each approximately 120°. The three-lobed cam inner surfaces 30*a*, 30*b* and 30*c* are configured to interface with a cage, which interfaces with a stud. Each lobe has a lobe centerline such as lobe centerline 31. Additionally, each lobe has a counterclockwise cam inner surface 32 on one side of the lobe centerline, and a clockwise cam inner surface 33 on the opposite side of the lobe centerline.

The illustrative lobe centerlines are 120° apart from each other. The illustrative counterclockwise cam inner surface 32 has a 60° arc, and the clockwise cam inner surface 33 also has a 60° arc. The illustrative counterclockwise cam inner surface 32 has a clockwise cam inner surface 33*a* and 33*b* on each side. Additionally, each clockwise cam inner surface 33 has a counterclockwise cam inner face 32 adjacent to the clockwise cam inner surface 33. Each lobe has a distal portion 35 along the lobe centerline that is furthest from the center of the housing.

In the embodiment presented in FIG. 3A, the distance between the distal portion of the lobe and the center of the housing is greater than the semi-circular radius used to form the counterclockwise cam inner surface 32 and the clockwise cam inner surface 33. In the illustrative embodiment shown in FIG. 3A, the semi-circular radius used to form the counterclockwise cam inner surface 32 and the clockwise cam inner surface 33 share the same center radius. Alternatively, the semi-circular radius used to form the counterclockwise cam inner surface 32 and the clockwise cam inner surface 33 may each have different center radius.

In the illustrative embodiment of FIG. 3A, the illustrative three-lobed cam inner surface includes six different cam inner surfaces, in which three cam inner surfaces are clockwise cam surfaces and three cam inner surfaces are counterclockwise cam surfaces.

Generally, a counterclockwise force (to loosen stud) is applied to the housing 20 for stud removal, this counterclockwise force is transferred to the cage 40, when the cage interfaces with the counterclockwise cam inner surface 32. There may be instances when stud removal requires the application of a clockwise force (tightening the stud) so the housing 20 is turned in a clockwise direction and this force is then transferred to the cage 40 with the clockwise cam inner surface 33. An illustrative impact wrench may be employed that has an operator controlled switch that can switch the direction of the force applied to the stud removal tool from counterclockwise, to clockwise, and back to counterclockwise. By performing this operation of oscillating between the counterclockwise and clockwise directions, additional torque may be transferred to more effectively remove the stud.

The illustrative three-lobed cam inner surface 30 is symmetrical and is presented for illustrative purposes only. Alternatively, other symmetrical lobed cam assemblies may also be used such as a two-lobed cam, a four-lobed cam, five-lobed cam, etc. The number of lobes and configuration of each lobe will depend on the particular application.

Additionally, each lobe may have more than just two symmetrical cam surfaces (i.e. clockwise inner cam surface and counterclockwise inner cam surface). For example, each lobe may have three, four, five or six different cam inner surfaces that can interface with different cages or cartridges.

Furthermore, asymmetrical cam inner surfaces may also be employed. Thus, the lobed cam inner surface may have additional surfaces beyond just the symmetrical three-lobed cam surface presented herein. The inner cam surface may be asymmetrical and include a plurality of surfaces that can interface with a plurality of different cages.

Figure 3B:
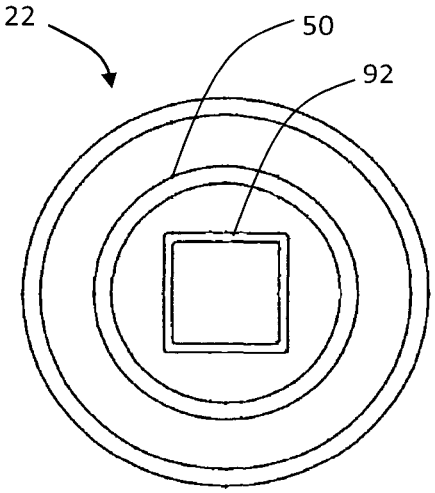
FIG. 3B shows a bottom view of the illustrative stud removal tool.
Figure 4:
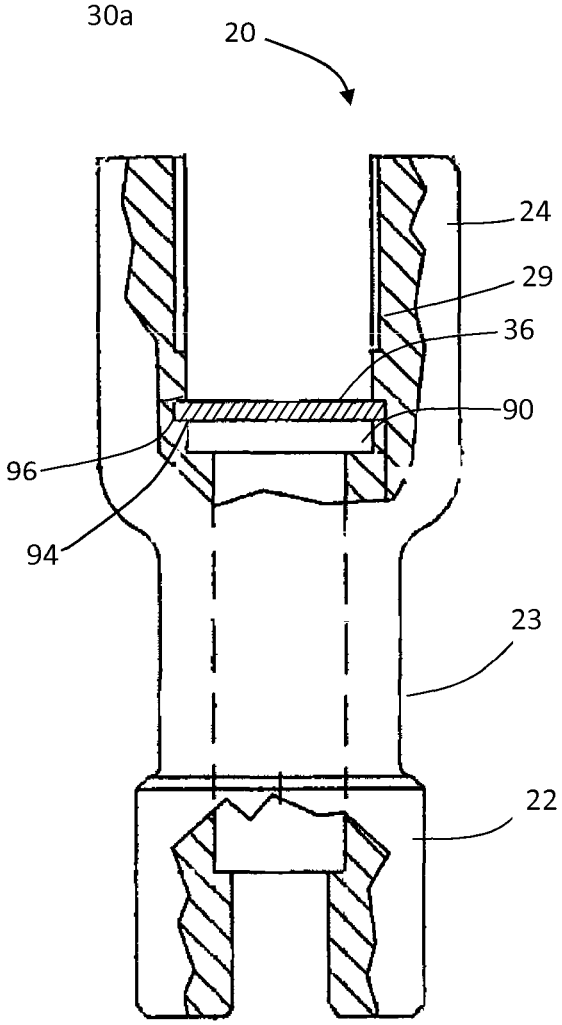
FIG. 4 shows a partial cross-sectional view of the stud removal tool without the cage.

Referring now to FIG. 3B, there is shown an illustrative bottom view of the bottom end 22. The O-ring 50 disposed on the bottom end 22 interface with a rotary power tool. The rotary power tool is configured to slidably couple with the polygon shaped opening 92. Alternatively, a second canted coil spring may be used instead of the O-ring 50. The second canted coil spring can also absorb additional axial loading, thus enabling the cage to effectively grip the stud with minimal interference from the compressive forces emanating from the rotary power tool.

The illustrative rotary power tool may be an impact wrench (not shown) having an anvil (not shown) configured to be received by a polygon shaped opening 92 at the bottom end 22 of the stud tool 10. Although the opening is shown as being square shaped, a circular or elliptical shaped opening may also be configured to match the shape of the rotary power tool.

An impact wrench is a power tool that delivers a high torque output by storing energy in a rotating mass and then delivering the energy to the output shaft. The power source for an impact wrench is generally compressed air. When a hammer, i.e. rotating mass, is accelerated by the power source and then connected to an anvil, i.e. output shaft, this creates the high-torque impact. When the hammer spins, the hammer's momentum is used to store kinetic energy that is then delivered to the anvil in a theoretically elastic collision having a very short impact force.

With an impact wrench, the only reaction force applied to the body of the tool is the motor accelerating the hammer, and thus the operator feels very little torque, even though a very high peak torque is delivered to the anvil. The impact wrench delivers rotational forces that can be switched between counterclockwise rotation and clockwise rotation. Additionally, impact wrenches deliver oscillating compressive forces along the axis of the anvil of the impact wrench. Thus, when removing a stud, the anvil of the impact wrench is along a vertical axis and the impact wrench delivers oscillating compressive forces along the axis of the anvil, i.e. axial load, and rotational forces.

For the embodiments described herein, very large impact wrenches are used. These very large impact wrenches can deliver several hundred thousand foot-pounds of torque and are usually suspended from a crane or lift, since the impact wrenches are too heavy for a person to lift. Alternatively, other power tools besides impact wrenches are used to deliver high impact torque for stud removal, such as a regular drill or other such power tool.

Referring to FIG. 4 there is shown a cross-sectional view of the housing 20. The housing groove 96 of the interior sidewall 29 is configured to receive the canted coil spring 36. The housing groove 96 extends around the inner perimeter of the housing 20. The groove 96 may include a shoulder 94 disposed below the interior sidewall 29. The middle section 23 may be solid or hollow depending on the design constraints for the stud removal tool 10. By way of example and not of limitation, the middle section 23 may be designed to be long enough to accommodate a stud or pin having a length up to five times its diameter.

The illustrative canted coil spring 36 may have the coils canted in either a clockwise or counterclockwise depending on the particular application and design constraints.

Figure 5A:
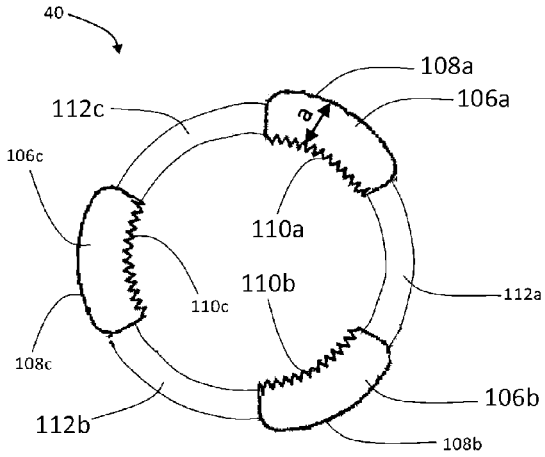
FIG. 5A shows a top view of an illustrative cage having jaws with cam outer surfaces.
Figure 5B:
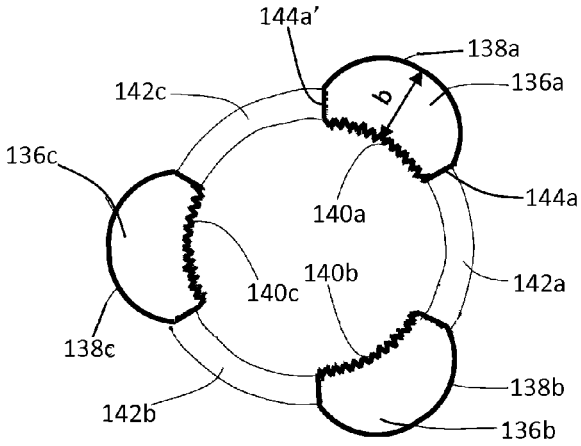
FIG. 5B shows a top view of an illustrative cage having jaws with rounded outer surfaces.

Referring to FIGS. 5A and 5B there is shown two illustrative embodiments of the jaws and the elastic webbing that surround the jaws. In FIG. 5A, each of the jaws 106*a*, 106*b* and 106*c* includes a jaw outer cam surface 108*a*, 108*b*, and 108*c* and an inner frictional surface 110*a*, 110*b*, and 110*c*, respectively. The jaw outer cam surface 108*a*, 108*b* and 108*c* are rounded, however the thickness or width "a" of the jaws 106*a*, 106*b* and 106*c* remain the same.

The illustrative elastic webbing 112 holds the jaws 106 symmetrically apart, retaining the jaws 106 firmly against the cam inner surface 30. The illustrative webbing 112*a* joins jaws 106*a* and 106*b*. Also, elastic webbing 112*b* joins jaws 106*b* and 106*c*. Additionally, webbing 112*c* joins jaws 106*a* and 106*c*. The webbing may also be embodied as an injection molded elastomeric cartridge or cage. By way of example and not of limitation, the bottom portion 107 of the cartridge is a steel ring that is fixedly coupled to the webbing 112.

By way of example and not of limitation the elastomeric component configured to join the jaws has a durometer ranging from 20-40. In a narrower embodiment, the elastomeric material has a durometer of 30. Generally, the webbing material is composed of an elastic material that can withstand operating conditions for stud removal. For example, the webbing matter may be composed of an elastic thermoplastic resin that is resistant to petroleum products. Also, other elastic or elastomeric materials such as rubber or neoprene may also be used.

In FIG. 5B, the jaws 136*a*, 136*b* and 136*c* includes a rounded jaw outer cam surface 138*a*, 138*b*, and 138*c* and an inner frictional surface 140*a*, 140*b*, and 140*c*, respectively. The jaw outer cam surface 138*a*, 138*b* and 138*c* are rounded, and the jaw thickness "b" for jaws 106*a*, 106*b* and 106 is greatest at the middle of the jaws and the jaw thickness is lowest at the edges 144*a* and 144*a*'. The illustrative elastic webbing 142*a* joins jaws 136*a* and 136*b*. Also, elastic webbing 142*b* joins jaws 136*b* and 136*c*. Additionally, webbing 142*c* joins jaws 136*a* and 136*c*.

Each jaw outer cam surface occupies a 60° arc. The jaw outer cam surface 108 or 138 is configured to interface with the cam inner surface 30 corresponding to the interior sidewall 29. The inner frictional surface 110 or 140 grips the stud. The inner frictional surface 110 or 140 may be ridge shaped or pyramid shaped, or any other such shape that can effectively grip the stud.

Figure 6A:
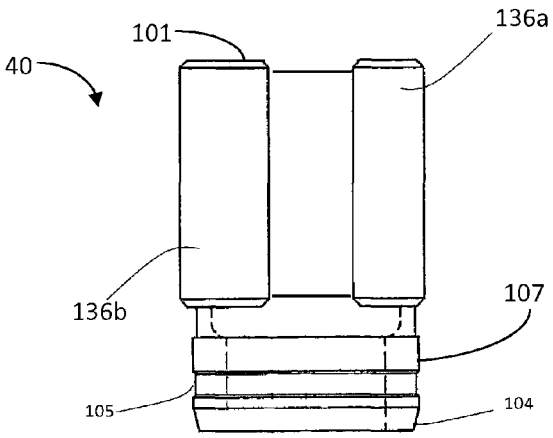
FIG. 6A shows a side view of the illustrative cage having jaws with rounded outer surfaces.
Figure 7:
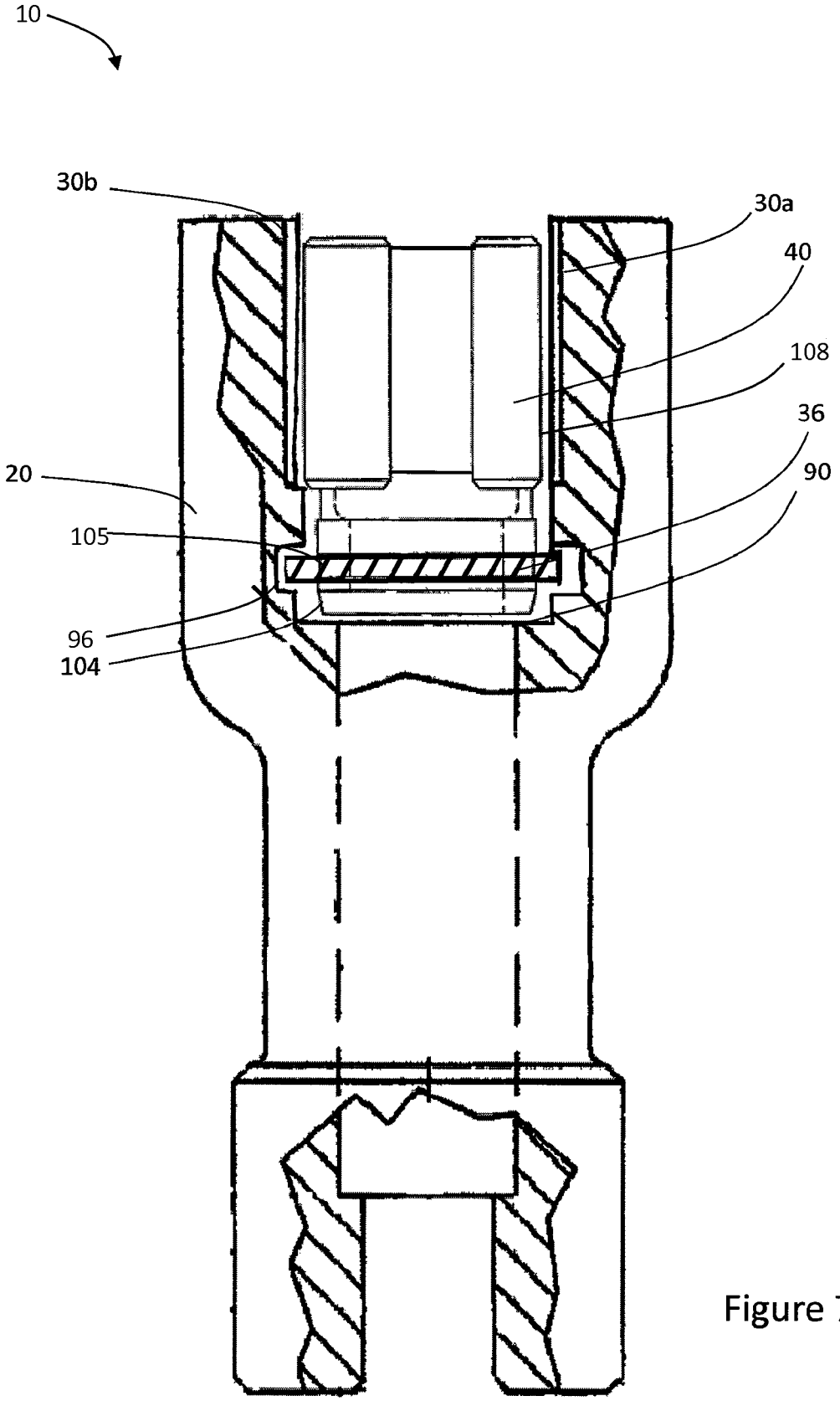
FIG. 7 shows a partial cross-sectional view of the stud removal tool with the cage and canted coil spring disposed inside the housing.

Referring to FIG. 6A, there is shown a side view of the illustrative cage 40 and the jaws 136 from FIG. 5B. The cage 40 is configured to interface with the interior sidewall 29 and with the canted coil spring 36. The cage 40 has a top surface 101 and a tapered terminus 104 configured to interface with the lip 90 of the housing 20. Additionally, the bottom portion 107 of the cage 40 has a cage groove 105 that is configured to interface with the canted coil spring 36 (shown in FIGS. 1A and 1B).

Figure 6B:
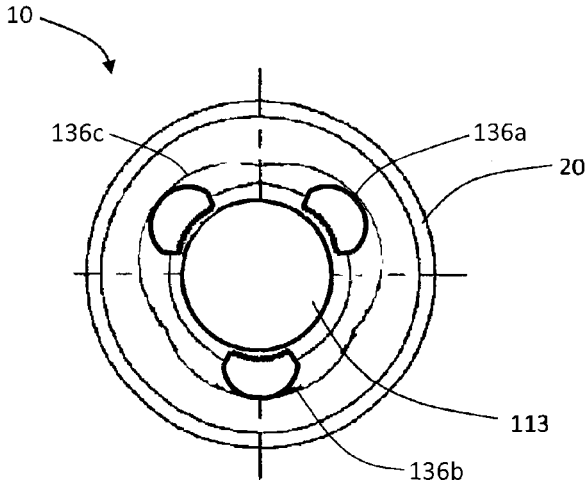
FIG. 6B shows a side view of the illustrative cage having jaws with rounded outer surfaces engaging an illustrative stud.

Referring now to FIG. 6B there is shown a sectional top view of the housing and the jaws interfacing with an illustrative stud 113. In FIG. 6B, the stud 113 is placed within the housing 20. The illustrative jaws 136*a*, 136*b* and 136*c* are shown in a resting position, in which no force is applied to the housing 20. In this resting position, the jaws 136 are not engaging the stud and the elastic webbing used to join the jaws causes the cams to return to the resting position, in which the jaw outer cam surface is configured to interface with the cam inner surface that is furthest from the illustrative stud 113. Thus, in this resting position the stud removal tool is capable of accepting the stud before a rotational force is applied to the stud.

When a counterclockwise force is applied to the housing that results in the housing shifting approximately 30° to the left and the jaws are biased radially inwards by the cam. The housing 20 is rotated by a rotary power source, such as the air impact wrench described above and the jaw outer cam surfaces 138*a*, 138*b* and 138*c* are configured to engage with the counterclockwise cam interface when a counterclockwise force is applied to the housing. When the jaws are biased radially inwards by the cam and the effective circumference of the cartridge is reduced, this causes the elastic webbing to flex (not shown). When the jaws are biased radially inwards, the inner frictional surface engages the stud.

More specifically, the stud removal tool is configured to turn in a counterclockwise manner. This rotation causes the cam inner surfaces 30*a*, 30*b* and 30*c* of the housing 20 to apply force to the cam outer surfaces 138 of the cartridge 40 containing the jaws 136*a*, 136*b* and 136*c*. The jaws 136*a*, 136*b* and 136*c* then rotate in a counterclockwise direction. In operation, the deformation of the elastomer upon the application of torque allows for the inner frictional gripping surface 140 of the jaws 136 to contact the stud 113 at multiple contact points.

Additionally, the jaw outer cam surface is configured to engage with the clockwise cam interface when a clockwise force is applied to the housing. During stud removal, the operator may increase the amount torque applied to the stud by toggling between applying a counterclockwise force and a clockwise force using the stud removal assembly described herein.

Figure 8:
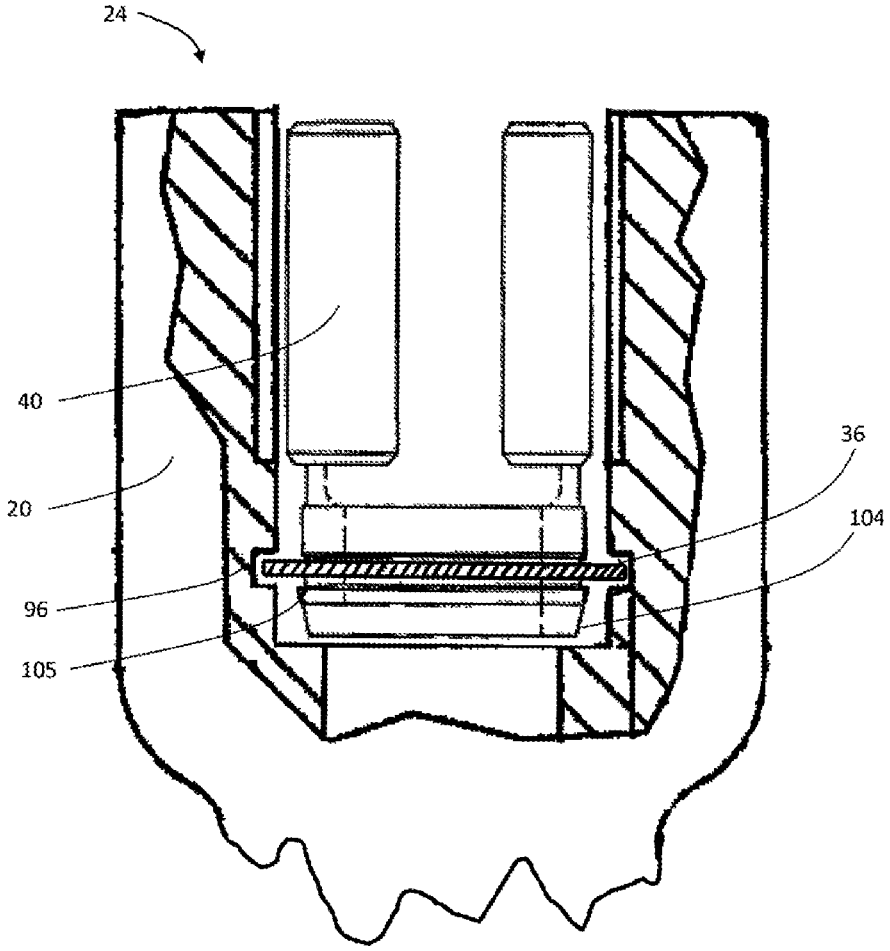
FIG. 8 shows a partial cross-sectional view of the top portion of the housing with the cage and canted coil spring disposed within the top portion of the housing.

Referring now to FIG. 7 and FIG. 8, when inserted into the housing 20, the cage 40 slidably engages with the cam inner surfaces 30*a*, 30*b* and 30*c* of the housing 20. The tapered terminus 104 slides past the canted coil spring 36 fitted within the housing groove 96, and the canted coil spring 36 is received by a cage groove 105. When the canted coil spring 36 is secured within both the housing groove 96 and the cage groove 105, the cage tapered terminus 104 latches under the canted coil spring 36, holding the cage 40 in place within the housing 20.

Figure 9:
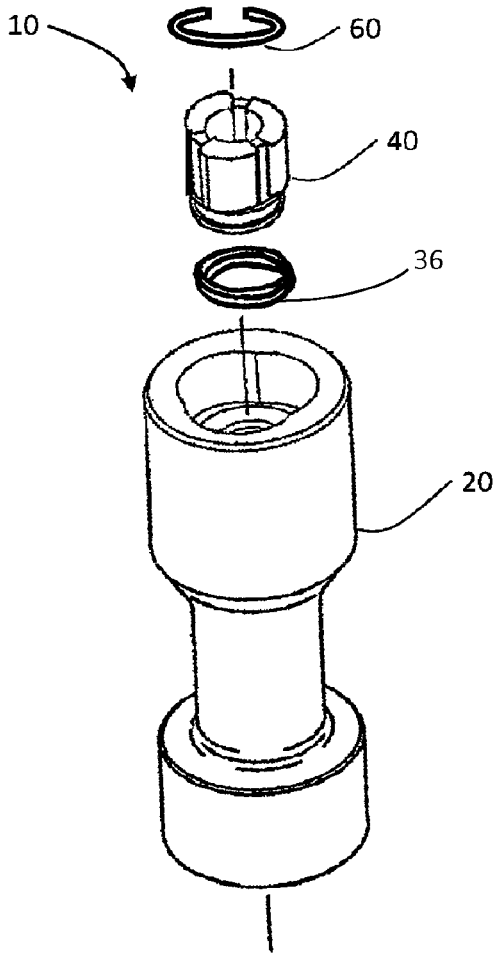
FIG. 9 shows an exploded isometric view of another illustrative stud removal tool, in which a retaining ring is used to hold the cage within the housing.

Referring to FIG. 9, there is shown an alternative embodiment of the stud removal tool 10, in which the cartridge 40 is also held in place within the housing 20 with an additional retaining ring 60. The retaining ring 60 can be used to keep the cage 40 from sliding out of the housing. Additionally, the retaining ring may also include a washer (not shown) that would be used to interface with the top surface of the cage 40.

The stud removal tool may have to remove very large studs, e.g. a stud weighing two hundred pounds, and so the retaining ring 60 may be used in conjunction with the canted coil spring 36 to rotatably couple the housing 20 to the cage 40. Although a properly designed canted coil spring can be used to rotatably engage the cage to the housing, the maintenance of the stud removal tool would be quite challenging. The maintenance challenge is removing a heavy-duty canted coil spring that can lift a heavy stud, e.g. 200 lbs., and a cage 40. For the illustrative 200 lb stud, the expected canted coil spring would need to support an axial load of 300 lbs. and a 300 lbs. spring would be difficult for an operator to remove. A retaining ring 60 can be used to reduce the axial load on the canted coil spring and so for very large studs, the operator that would be performing maintenance on the stud removal tool could, first, remove the retaining ring 60 that provides some axial support, second, remove the cage 40, and then remove the canted coil spring 36 that provides additional axial support.

Alternatively, the stud removal apparatus described above may not require a canted coil spring or other such seal preload device. Thus, the illustrative canted coil spring may simply be replaced with a retaining ring 60 described above. In addition to retaining ring 60 other fastening means may also be used.

Figure 10:
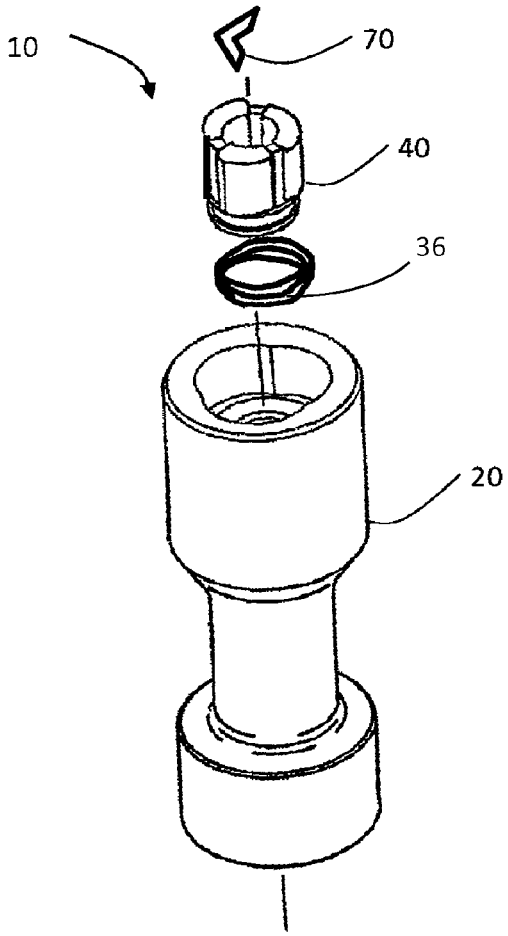
FIG. 10 shows an exploded isometric view of another illustrative stud removal tool, in which a clip is used to hold the cage within the housing.

For example, in FIG. 10 there is shown an alternative embodiment of the stud removal tool 10, in which the fastening means includes a clip 70. Fastening means shall readily suggest themselves to those of ordinary skill in the art. Generally, these fastening means may also be used that allow the cage 40 and the housing 20 to rotate freely in a counterclockwise or clockwise direction, while at the same time ensuring that the cage 40 does not slide out of the housing.

It is to be understood that the detailed description of illustrative embodiments provided for illustrative purposes. The scope of the claims is not limited to these specific embodiments or examples. Various structural limitations, elements, details, and uses can differ from those just described, or be expanded on or implemented using technologies not yet commercially viable, and yet still be within the inventive concepts of the present disclosure. The scope of the invention is determined by the following claims and their legal equivalents.

What is claimed is:

1. An apparatus for removing a stud, the apparatus comprising:

a housing having a top end, a bottom end, and a middle section disposed between the top end and the bottom end, wherein the top end includes:

a top surface having an orifice that extends through the top end;

an interior sidewall that extends from the top surface to a lip, wherein the interior sidewall includes, a three-lobed cam disposed along the interior sidewall of the top end, wherein each lobe has a lobe center line and a counterclockwise cam inner surface on one side of the lobe center line and a clockwise cam inner surface on the opposite side of the lobe center line, a groove disposed between the top surface and the lip;

a cage having a top surface, a bottom portion ending in a tapered terminus and a groove disposed between the top surface and the tapered terminus, the cage includes a plurality of jaws, in which each jaw includes, a jaw outer cam surface that is configured to interface with the cam inner surface corresponding to the interior sidewall;

an inner frictional surface configured to interface with the stud;

a canted coil spring configured to be received by the groove of the interior sidewall and the groove of the cage, wherein the canted coil spring is configured to rotatably couple the cage to the housing;

the housing configured to rotate counterclockwise relative to the cage;

the cage configured to rotate counterclockwise and engage the stud, the cage configured to interface with the interior sidewall; and the canted coil spring configured to operate within a constant deflection range, when an axial load is applied by the housing and cage.

2. The apparatus of claim 1 wherein the canted coil spring has coils canted in a clockwise direction.

3. The apparatus of claim 1 wherein the canted coil spring has coils canted in a counterclockwise direction.

4. The apparatus of claim 1 wherein the lobe centerlines for each lobe are 120° apart, each lobe occupies a 120° arc, the counterclockwise cam interface has a 60° arc and the clockwise cam interface has a 60° arc.

5. The apparatus of claim 4 wherein each lobe is substantially semi-circular.

6. The apparatus of claim 1 wherein each jaw outer cam surface occupies a 60° arc.

7. The apparatus of claim 6 wherein the jaw outer cam surface is configured to engage with the counterclockwise cam interface when a counterclockwise force is applied to the housing.

8. The apparatus of claim 7 wherein jaw outer cam surface is configured to engage with the clockwise cam interface when a clockwise force is applied to the housing.

9. The apparatus of claim 1 further comprising an elastic component configured to join the plurality of jaws.

10. The apparatus of claim 1 wherein the bottom end is configured to interface with an impact rotary tool that can oscillate between applying a counterclockwise force and a clockwise force.

11. The apparatus of claim 10 wherein the bottom end further comprises a slot configured to receive a pin that is inserted within the slot when the housing is configured to interface with the impact rotary tool.

12. An apparatus for removing a stud, the apparatus comprising:

a housing having a top end, a bottom end, and a middle section disposed between the top end and the bottom end, wherein the top end includes:

a top surface having an orifice that extends through the top end;

an interior sidewall that extends from the top surface to a lip, wherein the interior sidewall includes, a lobed cam disposed along the interior sidewall of the top end, wherein each lobe has a lobe center line and a counterclockwise cam inner surface on one side of the lobe center line and a clockwise cam inner surface on the opposite side of the lobe center line, a groove disposed between the top surface and the lip;

a cage having a top surface, a bottom portion ending in a tapered terminus and a groove disposed between the top surface and the tapered terminus, the cage includes a plurality of jaws, in which each jaw includes, a jaw outer cam surface that is configured to interface with the cam inner surface corresponding to the interior sidewall;

an inner frictional surface configured to interface with the stud;

a canted coil spring configured to be received by the groove of the interior sidewall and the groove of the cage, wherein the canted coil spring is configured to rotatably couple the cage to the housing;

the housing configured to rotate counterclockwise relative to the cage;

the cage configured to rotate counterclockwise and engage the stud, the cage configured to interface with the interior sidewall; and the canted coil spring configured to operate within a constant deflection range, when an axial load is applied by the housing and cage.

13. The apparatus of claim 12 wherein the canted coil spring has coils canted in a clockwise direction.

14. The apparatus of claim 12 wherein the canted coil spring has coils canted in a counterclockwise direction.

15. The apparatus of claim 12 wherein the jaw outer cam surface is configured to engage with the counterclockwise cam interface when a counterclockwise force is applied to the housing.

16. The apparatus of claim 12 wherein jaw outer cam surface is configured to engage with the clockwise cam interface when a clockwise force is applied to the housing.

17. The apparatus of claim 16 further comprising an elastic component configured to join the plurality of jaws.

18. The apparatus of claim 17 wherein the bottom end is configured to interface with an impact rotary tool that can oscillate between applying a counterclockwise force and a clockwise force.

19. The apparatus of claim 18 wherein the bottom end further comprises a slot configured to receive a pin that is inserted within the slot when the housing is configured to interface with the impact rotary tool.

20. An apparatus for removing a stud, the apparatus comprising:

a housing having a top end, a bottom end, and a middle section disposed between the top end and the bottom end, wherein the top end includes:

a top surface having an orifice that extends through the top end;

an interior sidewall that extends from the top surface to a lip, wherein the interior sidewall includes, a three-lobed cam disposed along the interior sidewall of the top end, wherein each lobe has a lobe center line and a counterclockwise cam inner surface on one side of the lobe center line and a clockwise cam inner surface on the opposite side of the lobe center line, a groove disposed between the top surface and the lip;

a cage having a top surface, a bottom portion ending in a tapered terminus and a groove disposed between the top surface and the tapered terminus, the cage includes a plurality of jaws, in which each jaw includes, a jaw outer cam surface that is configured to interface with the cam inner surface corresponding to the interior sidewall;

an inner frictional surface configured to interface with the stud;

a means for fastening the cage within the housing;

the housing configured to rotate counterclockwise relative to the cage;

the cage configured to rotate counterclockwise and engage the stud, the cage configured to interface with the interior sidewall.

21. The apparatus of claim 20 wherein the lobe centerlines for each lobe are 120° apart, each lobe occupies a 120° arc, the counterclockwise cam interface has a 60° arc and the clockwise cam interface has a 60° arc.

22. The apparatus of claim 20 wherein each lobe is substantially semi-circular.

23. The apparatus of claim 20 wherein each jaw outer cam surface occupies a 60° arc.

24. The apparatus of claim 23 wherein the jaw outer cam surface is configured to engage with the counterclockwise cam interface when a counterclockwise force is applied to the housing.

25. The apparatus of claim 24 wherein jaw outer cam surface is configured to engage with the clockwise cam interface when a clockwise force is applied to the housing.

26. The apparatus of claim 20 further comprising an elastic component configured to join the plurality of jaws.

27. The apparatus of claim 20 wherein the bottom end is configured to interface with an impact rotary tool that can oscillate between applying a counterclockwise force and a clockwise force.

28. The apparatus of claim 27 wherein the bottom end further comprises a slot configured to receive a pin that is inserted within the slot when the housing is configured to interface with the impact rotary tool.

29. The apparatus of claim 20 wherein the means for fastening the cage within the housing is a retaining ring.

30. The apparatus of claim 20 wherein the means for fastening the cage within the housing is a clip.

* * * * *